US006663186B1

(12) United States Patent
Kosobrodov et al.

(10) Patent No.: US 6,663,186 B1
(45) Date of Patent: Dec. 16, 2003

(54) CUTTING BIT

(75) Inventors: Yuriy Kosobrodov, Las Angeles, CA (US); Vincent Jue, Rolling Hills East, CA (US)

(73) Assignee: Champion Equipment Corp., Paramount, CA (US)

( * ) Notice: Subject to any disclaimer, the term of this patent is extended or adjusted under 35 U.S.C. 154(b) by 0 days.

(21) Appl. No.: 09/337,004

(22) Filed: Jun. 28, 1999

(51) Int. Cl.[7] ..... E21C 35/18
(52) U.S. Cl. ..... 299/101; 299/111; 299/112
(58) Field of Search ..... 299/79.1, 85.2, 299/101, 111, 112; 125/41, 42, 43; 30/169; 175/383

(56) References Cited

U.S. PATENT DOCUMENTS 111,952 A * 2/1871 Locke ..... 403/253
994,668 A * 6/1911 Childs ..... 175/383
2,297,362 A * 9/1942 Morrow ..... 299/112
3,833,264 A * 9/1974 Elders ..... 299/110
3,968,550 A * 7/1976 Gehri ..... 407/114
4,193,638 A * 3/1980 Heckenhauer ..... 299/101
4,487,534 A * 12/1984 Reiter ..... 407/114

* cited by examiner

*Primary Examiner*—Heather Shackelford
*Assistant Examiner*—John Kreck
(74) *Attorney, Agent, or Firm*—I. Zborovsky

(57) ABSTRACT

A cutting bit has a bit body, and a cutting element formed as a trihedron with three faces which form three rock destructing blades, so that the cutting bits can be turned to orient alternatively a respective one of the rock destructing blades in a cutting direction in the event of dulling or breaking of another one of the rock destructing blades.

3 Claims, 4 Drawing Sheets

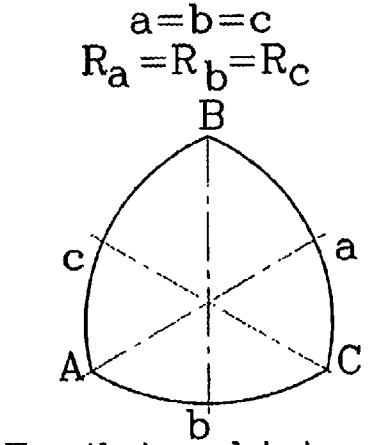
Equilateral triangle
*FIG. 3*
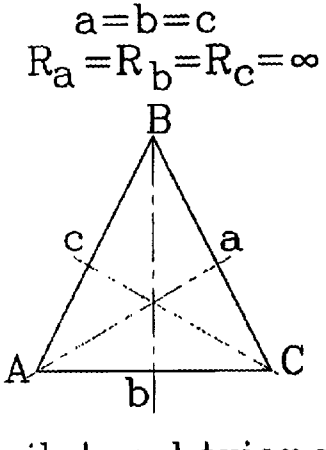
Equilateral triangle
*FIG. 4*
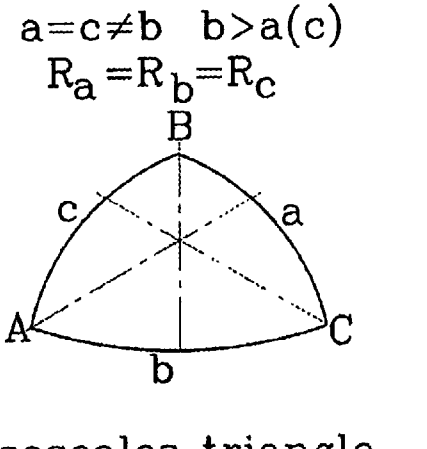
Isoscales triangle
*FIG. 5*
Scalese triangle
*FIG. 6*
Equilateral triangle
*FIG. 7*
Equilateral triangle
*FIG. 8*

SECTION I–I

CUTTING BIT

BACKGROUND OF THE INVENTION

The present invention relates generally to cutting bits (tools), which can be applied for excavation, planing, drilling and surface finish of the sock, concrete, soil and other non-metallic materials and be mounted on corresponding equipment, intended for cutting (treatment) of the above mentioned materials.

Cutting bits of the above mentioned general type are known in the art.

The typical disadvantages of the existing cutting bits are their limited strength and the cutting edge and blade of the cutting bits after certain period is subjected to dulling and breaking.

It is therefore believed to be clear that it is desirable to improve the existing cutting bits in these aspects.

A plurality of tool have been developed with the objective to protect cutting bits from breakage and intensive fast wear.

U.S. Pat. No. 1,174,433 discloses flat one-bladed cutter set with cutting element having convex front face and sole cutting edge, of the limited length. Said bit has sufficient cutting ability but insufficient durability and reliability.

U.S. Pat. Nos. 4,538,691 and 4,678,237 disclose flat one-bladed tools set with cutting element having flat face, oriented at a substantial negative rake angle, that can protect bit cutting edge from overloading by providing a lifting force, but reduce bit cutting ability and wear resistance.

U.S. Pat. Nos. 4,538,690; 4,558,753 and 4,593,777 discloses flat one-bladed bit set with cutting element having concave front face, oriented at a large negative rake angle that can prevent bit overloading for uniform rock destruction; however, described tools have insufficient cutting ability and wear resistance.

U.S. Pat. No. 5,078,214 discloses round one-bladed bit set with cutting element having flat or concave front face, that decreases bit strength due to shear stresses generation within cutting element.

U.S. Pat. No. 5,496,131 discloses round one-bladed bit of the road planing cutter, set with replaceable cylindrical cutting element, having flat or concave front face that can increase bit cutting ability but decreases its durability and reliability.

U.S. Pat. No. 5,520,444 discloses round one-bladed bit set with cylindrical cutting element having convex front face but devoid of side cutting edge that can decrease bit cutting ability, especially in corner zones.

German Patent Nos 3234521 and 3336154 discloses one-bladed round tubular chisel, set with cutting element, having concave front face and limited included angle; bit front face is oriented at significant positive rake angle. Combination of the bit listed signs provided bit insufficient strength and wear resistance.

USSR Pat. No. SU-1671850-A1 discloses round one-bladed cutter set with cylindrical cutting element having flat front face, oriented at a substantial negative rake angle that can increase bit strength but decrease its cutting ability and wear resistance.

SUMMARY OF THE INVENTION

Accordingly, it is an object of the present invention to provide a cutting bit, which is a further improvement of the existing cutting bits of this type. In keeping with these objects and with others which will become apparent hereinafter, one feature of present invention resides, briefly stated, in a cutting bit, which has a bit body, and a cutting element formed as a trihedron with three curvilinear convexo-convex outer faces, which form the material destructing blades, so that the cutting bit can be turned to orient alternatively a respective one of the destructing blades in a cutting direction in the event of dulling or breaking of the destructing blades.

When the cutting bit is designed in accordance with the present invention, then after dulling or breaking of one of the faces of the cutting element which forms the corresponding cutting blade, the bit body together with the cutting element is turned so that another face or in other words a new material destructing blade is oriented in the cutting direction and that not worn and not damaged face or cutting blade can now successfully cut material and the like.

As a result, the service lifetime of the bit is increased since effective length of the cutting edge is trebled; the bit has high strength because bit cutting faces are convexo-convex and therefore promote generation within these faces materials (especially, carbide and other hard brittle alloy) predominant compressive stresses, instead of destructive shear and tensile ones; and the bit has high destructive ability due to the presences of lateral cutting edges.

In accordance with another embodiment of the present invention, the cutting element in a cross-section is formed as a triangle, which can have sides of the different lengths and inner (included) angles of the different values. In this case, the bit can be applied for destructing of the materials which are substantially distant from one another with regard to their hardness and other properties. That is, a fixed setting of a plurality of bits can be optimized for penetration ability or surface finish solely by choice of proper bit face orientation.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIGS. 3, 4, 5, 6, 7 and 8 are plan views of the cutting element of the inventive cutting bit;

DESCRIPTION OF PREFERRED EMBODIMENTS

Figure 1:
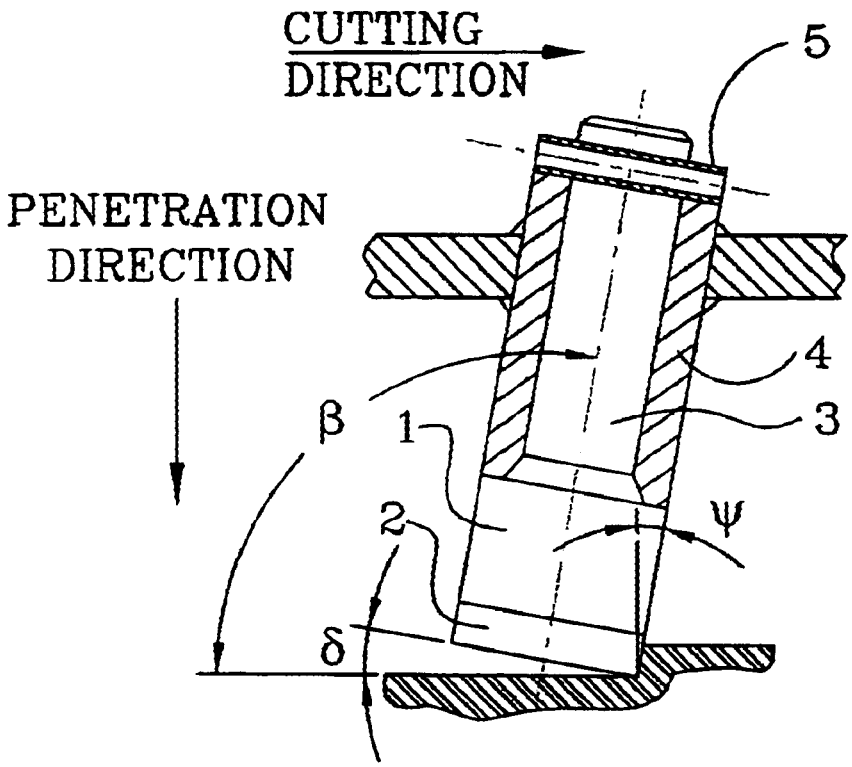
FIG. 1 is a view showing a cutting device provided with that cutting bit in accordance with the present invention.
Figure 2:
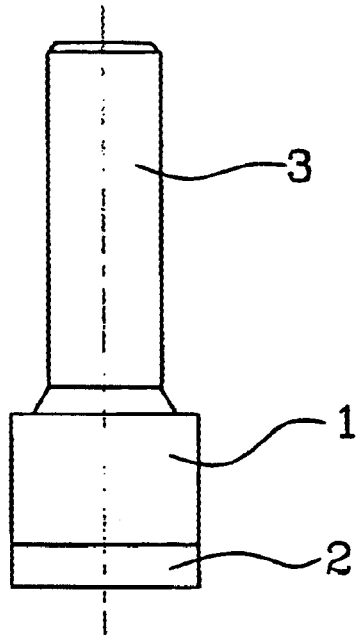
FIG. 2 is a front view of the cutting bit of FIG. 1.

A cutting bit (FIGS. 1, 2, 9 and 12) in accordance with the present invention has a bit body which is identified with reference numeral 1 and a cutting element which is identified with reference numeral 2.

As can be seen from FIG. 1 the fail part 3 of the bit is arranged in a bit holder 4 and retained by pin 5. The bit holder or a plurality of bit holders are aligned with respect to each other and attached to cutter support. Described mounting of the bit holder to cutter support allows to provide required cutting angles: attack angle β, rake angle Ψ and relief angle δ.

As can be seen from FIGS. 2, 3, 4, 5, 6, 7 and 8, the cutting element 2 is formed as a trihedron which has three faces and forming cutting or material destructing blades with cutting edges identified with reference to letter a, b, and c. Faces of the cutting element can have flat shape or convex curvilinear shape. That's why faces of the cutting element can together form a cross-sections shaped as rectilinear triangle (FIG. 4) or curvilinear triangle (FIGS. 3, 5, 6, 7 and 8). The triangle can be equilateral triangle (FIGS. 3, 4, 7 and 8) isosceles triangle (FIG. 5) or scalene triangle (FIG. 6). The sides of the triangle can have a same curvature (FIGS. 3, 4, 5, and 6) different curvatures (FIG. 7) of two sides can have the same curvature while a third side can have different curvature (FIG. 8).

The shortest distance between the two next apexes of the triangle in the cross-section of the cutting element constitutes a width of the corresponding cutting blade or in other words a cutting width. Cutting width of all three cutting blades can be identical (FIGS. 3, 4, 7 and 8) or the cutting width of all three blades can be different (FIG. 6), or two blades can have the same width, while the width of a third blade can be different (FIG. 5).

In operation one side of the trihedron is oriented in a cutting direction, for example, the lower side 6 (FIGS. 3, 4, 5, 6, 7, 8 and 15). The other side "c" and "a" form lateral destructing blades (edges). As can be seen from FIG. 15, each side of the trihedron or in other words each cutting blade (edge) can be oriented in a cutting direction by turning of the cutting element or a cutting bit as a whole. FIG. 15 also comprises equation for determination of the parameters for trihedron in cross-section for any design of the trihedron.

Figure 9:
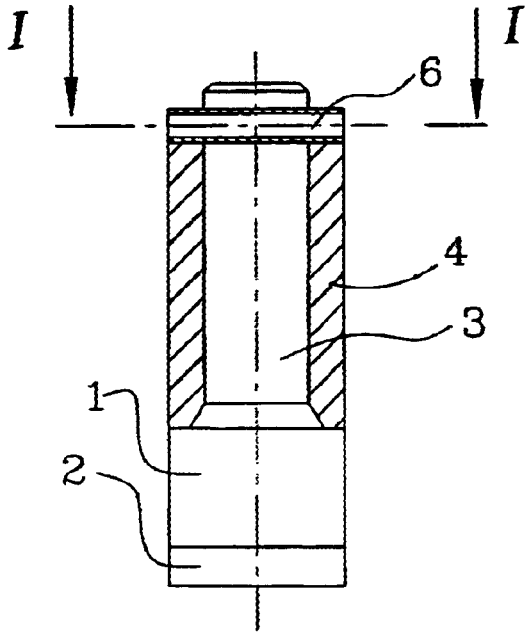
FIG. 9 is a front view of the cutting bit together with its holder.
Figure 11:
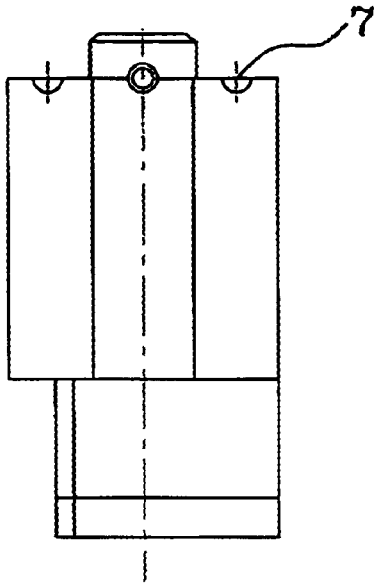
FIG. 11 is a side view of the cutting bit of FIG. 9.

As can be seen from FIG. 9 cutting bit further has a support element which is identified with reference numeral 4 and is formed for example as a bushing with a central opening. Tail part 3 of the bit body is cylindrical and is received in a cylindrical inner opening of the bushing 4. The bushing 4 has three intersecting pairs of openings 7 shown in FIG. 11, and extending transversely to central, bit tail receiving opening of the bushing, at the bottom of the bushing. A lower end of the bit tails 3 (FIG. 9) has a transverse throughgoing opening 6.

Figure 10:
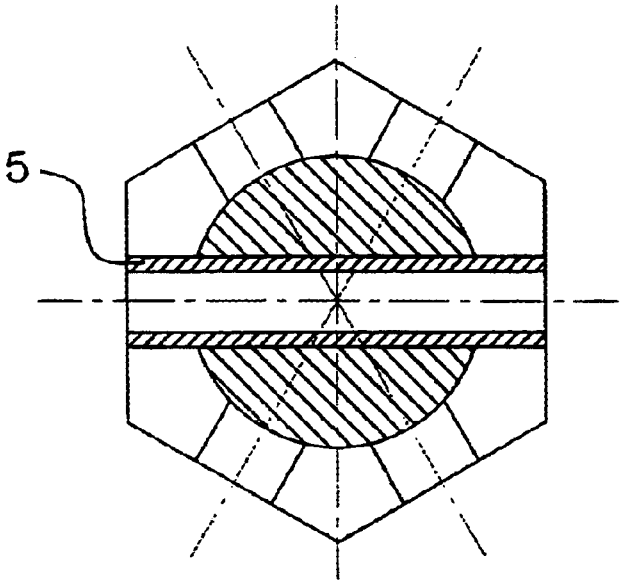
FIG. 10 is a cross-section of the cutting bit of FIG. 9.

In order to orient respective blade of the cutting element 2 in a cutting direction, cutting bit is turned in the central opening of the bushing 4 so that transverse opening 6 of the bit tail 3 coincides with respective one of the transverse openings 7 of the bottom of the bushing. The pin 5 (FIG. 10) is inserted in the coinciding opening to fix cutting bit in corresponding position.

In order to orient another blade of the cutting element 2 in a cutting direction, the pin 5 is then removed and cutting bit is turned in the bushing central opening so that the transverse opening 6 of the tail 3 can be aligned with another transverse opening 7 of the bushing 4 and the pin 5 is inserted in the coinciding opening.

Figure 12:
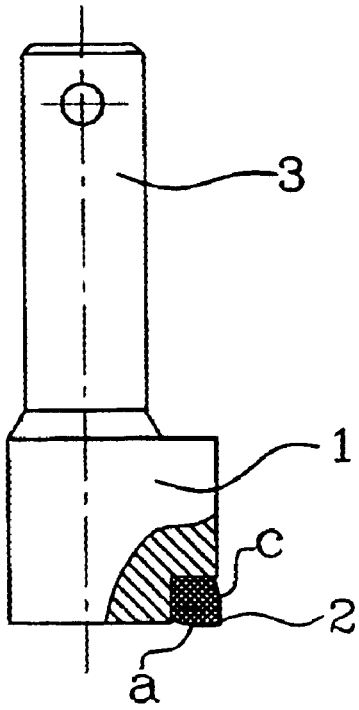
FIG. 12 is a side view of the cutting bit of FIG. 2.

As can be seen from FIG. 12 cutting element 2 has vertical face "d" and horizontal face "e". These surfaces can have flat shape or convex curvilinear shape. Combination of the convex cirvilinear shape of the surface "d" from FIG. 12 (longitudinal section of the cutting element) with convex cirvilinear shape of the surface ("a" or "b") in the cross-section of the cutting element (FIGS. 3, 5, 6, 7 and 8) means that front face of the destructing blade has convexo-convex shape. This blade shape provides high strength of the cutting element as a whole. For described shape service load by the destroyed material respective force generates predominant compressive stress instead of destruction shear stress and tensile stress.

Figure 13:
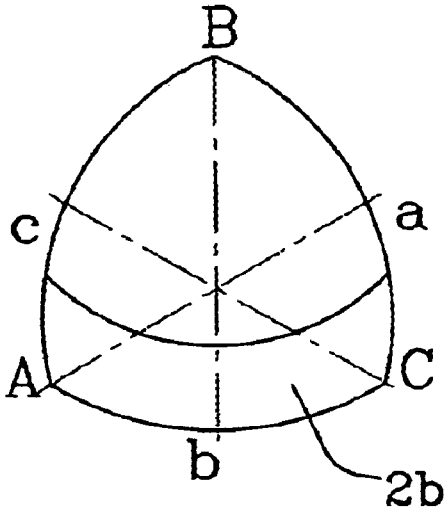
FIGS. 13 and 14 are plan views of the cutting bit of FIG. 12.
Figure 14:
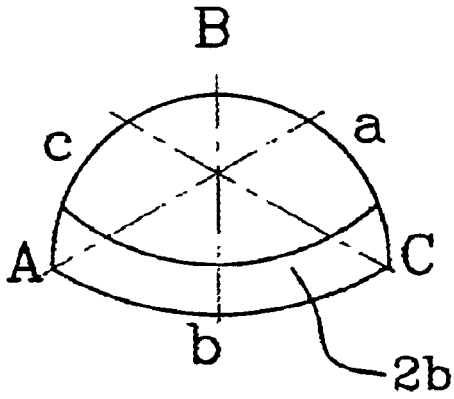

As can be seen in the embodiment from FIGS. 13 and 14 on face (destructing blade) of the cutting element 2, in particular the face b, is formed by a reinforcing insert $2^b$.

While the cutting element 2 as a whole can be composed of steel, the insert $2^b$ can be composed for example of tungsten carbide. It is believed to be clear that all faces ("a", "b", and "c"), or two faces can be reinforced by inserts of stronger material than the inner portion of the cutting element.

In the embodiment shown in FIG. 14 differs from the previous design in that one of corners of a triangle of the cutting element cross-section for example corner B is rounded.

It will be understood that each of the elements described above, or two or more together, may also find a useful application in other types of constructions differing from the types described above.

While the invention has been illustrated and described as embodied in cutting bit, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic of specific aspects of this invention.

What is claimed as new and desired to be protected by Letters Patent is set forth in the appended claims.

What is claimed is:

1. A cutting bit, comprising a bit body; and a cutting element formed as a trihedron with three faces which form free rock destructing blades, so that said cutting bit can be turned to orient alternatively respective one of said rock destructing blades in a cutting direction in the event of dulling or breaking of another one of said rock destructing blades, wherein said faces of said cutting element have different strengths.

2. A cutting bit, comprising a bit body; and a cutting element formed as a trihedron with three faces which form free rock destructing blades, so that said cutting bit can be turned to orient alternatively respective one of said rock destructing blades in a cutting direction in the event of dulling or breaking of another one of said rock destructing blades, wherein at least one of said faces is composed of a material which is different from a material of another face.

3. A cutting bit, comprising a bit body; and a cutting element formed as a trihedron with three faces which form free rock destructing blades, so that said cutting bit can be turned to orient alternatively respective one of said rock destructing blades in a cutting direction in the event of dulling or breaking of another one of said rock destructing blades, at least one of said cutting elements is provided with a reinforcing insert, said reinforcing inset having a side forming said one face and being rounded, a second side being substantially perpendicular to said first side and curved, and a third side which is substantially perpendicular to said first mentioned side and being also curved.

* * * * *